US005393384A

United States Patent [19]

Steiner et al.

[11] Patent Number: 5,393,384

[45] Date of Patent: Feb. 28, 1995

[54] PAPER MACHINE FOR THE PRODUCTION OF TISSUE PAPER

[75] Inventors: Karl Steiner, Herbrechtingen; Albrecht Meinecke, Heidenheim, both of Germany; Rui Goncalves, Sao Paulo, Brazil

[73] Assignee: J. M. Voith GmbH, Heidenheim, Germany

[21] Appl. No.: 97,568

[22] Filed: Jul. 27, 1993

[30] Foreign Application Priority Data

Jul. 27, 1992 [DE] Germany ..... 4224730

[51] Int. Cl.[6] ..... D21F 3/04

[52] U.S. Cl. ..... 162/359.1; 162/206; 162/301; 162/358.3; 162/360.2; 162/360.3

[58] Field of Search ..... 162/206, 358.3, 358.5, 162/359.1, 360.2, 360.3, 300, 301

[56] References Cited

U.S. PATENT DOCUMENTS

| | | | |
|---|---|---|---|
| 4,055,461 | 10/1977 | Turunen | 162/360.3 |
| 4,144,124 | 3/1979 | Turunen et al. | 162/359.1 |
| 4,483,745 | 11/1984 | Wicks et al. | 162/360.2 |
| 4,526,655 | 7/1985 | Karrinen et al. | 162/360.2 |
| 4,738,752 | 4/1988 | Busker et al. | 162/358.5 |
| 4,915,790 | 4/1990 | Dahl | 162/360.2 |
| 4,976,820 | 11/1990 | Laapotti | 162/360.3 |
| 4,988,410 | 1/1991 | Meinecke et al. | 162/360.3 |

FOREIGN PATENT DOCUMENTS

3112070A1 10/1982 Germany .

*Primary Examiner*—Karen M. Hastings
*Attorney, Agent, or Firm*—Baker & Daniels

[57] ABSTRACT

The invention is directed to a paper machine for the production of a fiber web, including a headbox for forming the fiber web. Disposed adjacent the headbox is either a dewatering unit, e.g., a dewatering cylinder, a double wire former or a four-drinier wire section. Also provided are at least one press unit for dewatering the fiber web, a tissue drying cylinder for finish drying the fiber web, a device for fiber web pickup from the tissue drying cylinder (Yankee cylinder), e.g., a creping doctor or a Clupak device, and a carrier belt for carrying the fiber web. At least one of the press units is configured as a shoe press for drying the fiber web, and includes a device for immediately separating the fiber web from a press felt after at least one press pass. The belt is preferably water impermeable, and an adhesion force between the water impermeable belt and the fiber web is greater than an adhesion force between the press felt and the fiber web.

3 Claims, 8 Drawing Sheets

PAPER MACHINE FOR THE PRODUCTION OF TISSUE PAPER

BACKGROUND OF THE INVENTION

1. Field of the invention

The invention concerns a paper machine for the production of tissue paper.

2. Discussion of the Related Art

Reference is made to DE 31 12 070 A1.

As known, tissue paper is normally produced in a fashion such that the web is formed on a relatively short wire section resembling a four-drinier wire, where the headbox applies the fiber suspension on the wire in the region of a breast roll which frequently is open or provided with an inner vacuum, where the web—for backing by the wire—runs past conventional dewatering elements, for instance register rolls, deflectors, foil slats, suction boxes and a suction roll, of which each withdraws water from the fiber web. At the end of the wire section, the web transfers onto a so-called pick-up felt, with the aid of which it proceeds for further drying to the press section and drying section.

With the dual wire machine customary nowadays, the stock is injected as a machine-wide jet from the headbox nozzle into the wedge-shaped entrance gap between the two wires. It runs then, between the wires, around the shell of the forming cylinder and, as a still moist web, is then carried off by one of the wires. A press felt, or also pick-up felt, then picks the web up off the wire. The press section consists again of usual presses provided with two press rolls and a press felt, or a large-diameter tissue cylinder (Yankee cylinder) is used as one of the two press rolls.

With these prior tissue paper machines, a considerable disadvantage is constituted by the fact that the tissue web, in the press section, always clings to the press felt, whereby a strong tendency of remoistening the tissue web by this press felt is given, and the drying of the tissue web is thus considerably impeded, so that more press cylinders than necessary are being used.

The problem underlying the invention consists in achieving an overall arrangement of a tissue paper machine such that, for one, a remoistening of the tissue web will be avoided and, for another, a tissue machine design will be found which requires as few press units as possible.

The prevailing opinion in selecting suitable drying presses in contingence on the web thickness so far has been that for drying thin webs there are only simple roll presses suited which generate a sufficiently high contact pressure for a short time, thus optimally removing the water from a thin web (tissue web) due to the short path, whereas shoe type presses are suited essentially for drying thick, heavy webs, since they generate a persistent pressure which allows the water sufficient time for the considerably longer path in leaving the web.

SUMMARY OF THE INVENTION

The present invention provides a paper machine for the production of tissue paper where the fiber suspension proceeds from a headbox to a sheet formation unit. Supported by the main wire, the web is passed to a four-drinier section provided with dewatering means and from there, in pressed state, to a drier and subsequently to a winding apparatus.

The invention comprises, in one form, a paper machine for the production of a fiber web, including a headbox for forming the fiber web. Disposed adjacent the headbox is either a dewatering unit, e.g., a dewatering cylinder, a double wire former or a four-drinier wire section. Also provided are at least one press unit for dewatering the fiber web, a tissue drying cylinder for finish drying the fiber web, a device for fiber web pickup from the tissue drying cylinder (Yankee cylinder), e.g., a creping doctor or a Clupak device, and a carrier belt for carrying the fiber web. At least one of the press units is configured as a shoe press for drying the fiber web, and includes a device for immediately separating the fiber web from a press felt after at least one press pass. The belt is preferably water impermeable, and an adhesion force between the water impermeable belt and the fiber web is greater than an adhesion force between the press felt and the fiber web.

The inventors have recognized that, surprisingly, the drying effect of the shoe press generates a considerably higher degree of drying (about 57% dry content) than a corresponding roll press (about 47% dry content). This, in conjunction with a nonabsorbent belt which avoids a remoistening of the web, results in considerably increased drying capacities of a press unit.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
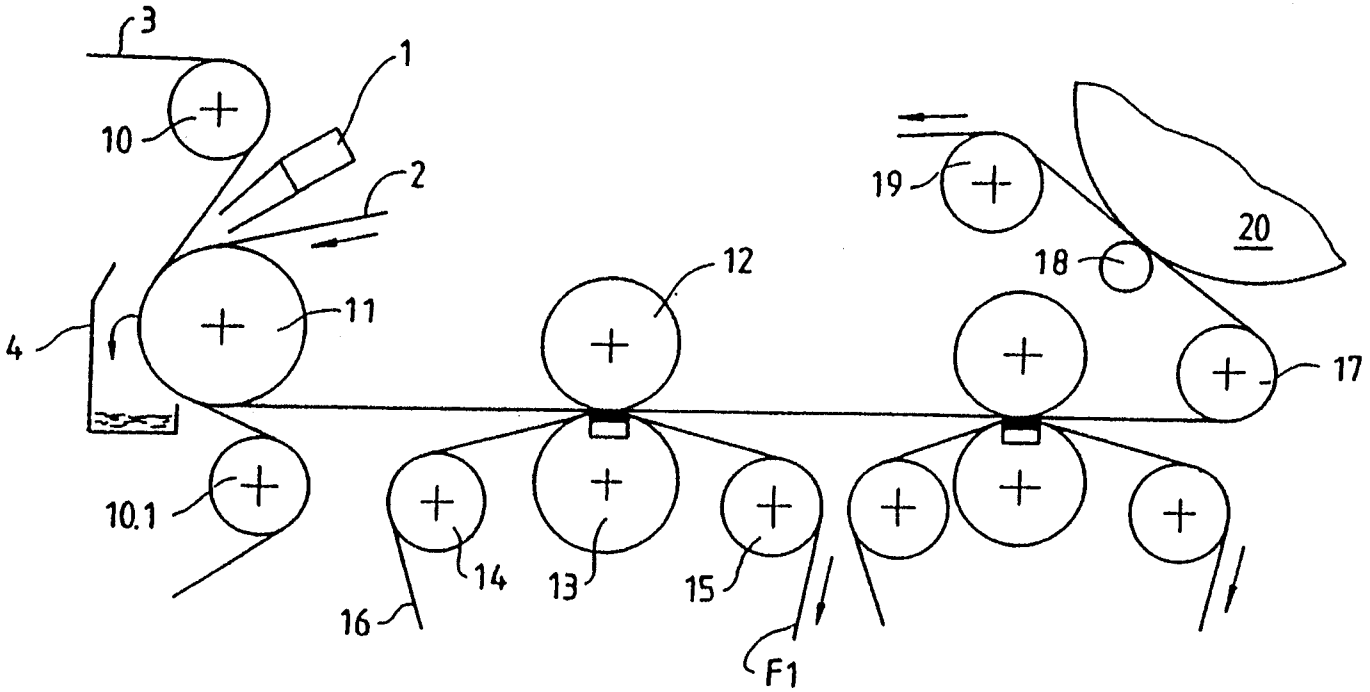
FIGS. 1–7 illustrate alternative embodiments of the present invention having a paper machine for the production of tissue paper including a shoe press.

FIG. 1 shows a paper machine for the production of tissue paper from the headbox to the tissue cylinder. On the left it depicts a headbox 1 which injects the fiber suspension, from above right at an angle of about 45°, between a water-impermeable belt 2 and a wire 3. Wire 3, over a reversing roll 10, approaches from above and unites with belt 2, with the fiber suspension sandwiched between belt 2 and wire 3, at a sheet former roll 11, in the wrap region of which a one-sided dewatering device 4 is provided which extends through wire 3. Downstream from roll 11, belt 3 is deflected again via another roll 10.1 and separated from the paper web, while belt 2, coming from roll 11, runs horizontally into the first press gap. The first press is fashioned as a shoe press with an overhead backing cylinder 12 and a shoe press 13 placed underneath. Shoe press 13, from the left across a reversing roll 14, passes through the press gap a felt 16 which immediately after the press gap lifts off the web again and runs over a further reversing roll 15.

The paper web, bearing on water-impermeable belt 2, travels on in straight direction into the second press gap of identical design as the first and, thereafter, is reversed over a reversing roll 17, approaches tissue drying cylinder 20 upwardly, with the transfer being supported by a contact roll 18 and the belt returning, after transfer of the paper web, via a reversing roll 19 to headbox 1.

Figure 2:
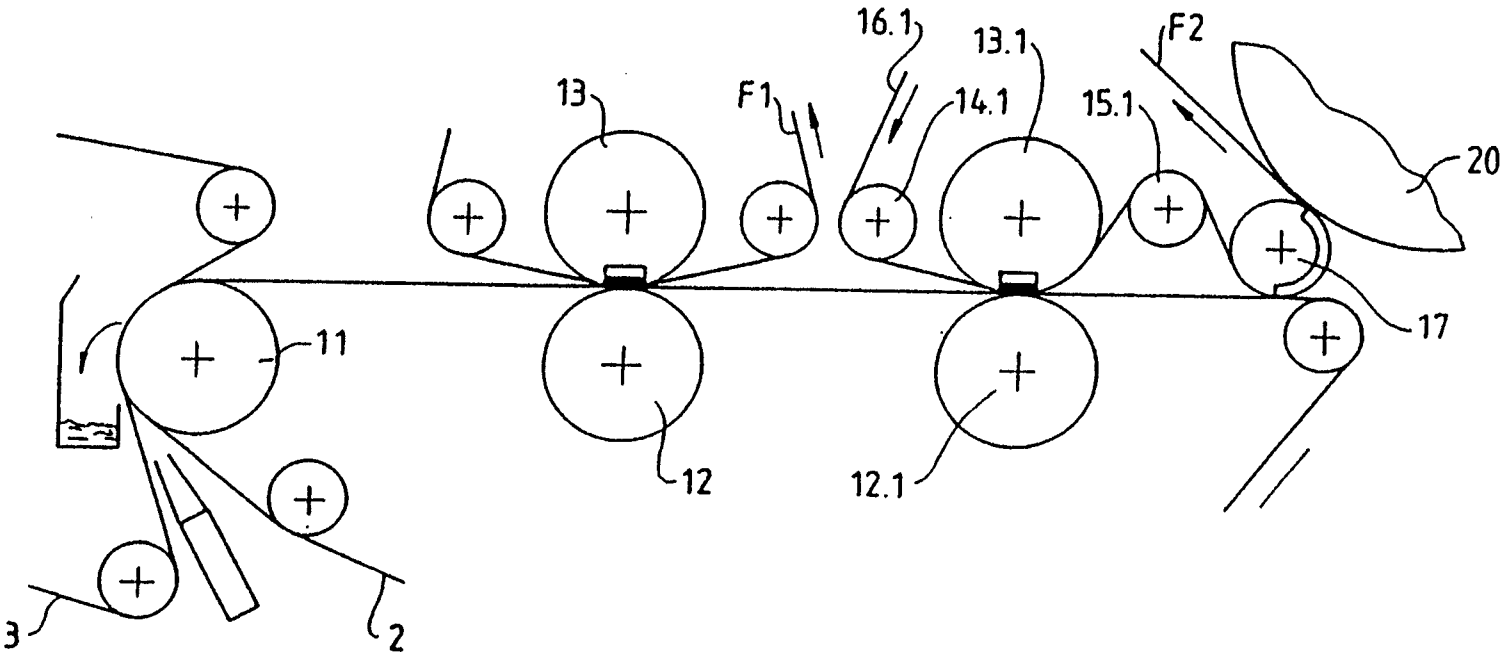

FIG. 2 shows an arrangement similar to that in FIG. 1, with the difference that the headbox feeds the fiber suspension not from above, but from below, to a sheet former roll 11, between a water-impermeable belt 2 and a wire 3. Following then, as in FIG. 1, is a shoe press, with shoe press unit 13 arranged overhead in this variant while backing roll 12 is placed underneath. Next, with the tissue web upon it, belt 2 continues to a second shoe press 13.1, which again is located above belt 2 and acts against a backing roll 12.1. The pertaining felt 16.1, coming from above, runs over a reversing roll 14.1 to the press gap, lifts after the press gap immediately off the web again via a reversing roll 15.1 installed above and returns, this time after this reversing roll though, to a transfer roll 17 fashioned as a suction roll. This suction roll 17 picks the tissue web up from belt 2 and transfers it by direct contact with tissue drying cylinder 20 to same, whereas felt 16.1 returns to reversing roll 4.1. Belt 2 runs after the transfer of the tissue web back to headbox 1 via a reversing roll 18.

Figure 3:
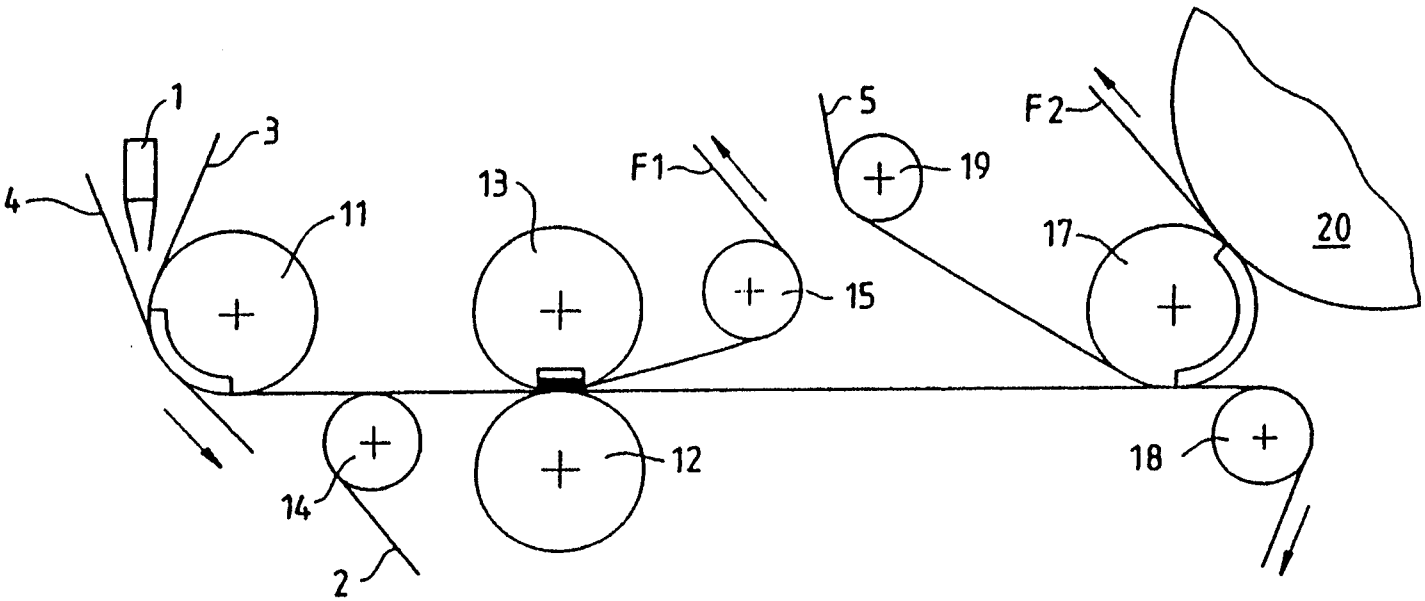

FIG. 3 shows a paper machine for the production of tissue paper consisting of a headbox arranged on the left and injecting its fiber suspension in a downward direction between an overhead felt 3 and a wire 4, with first sheet former roll 11, in the wrap region of felt 3 and wire 4, fashioned as a suction roll. After wrapping around suction roll 11, wire 4 departs downwardly while the formed tissue web continues together with the felt toward a shoe press. Between suction roll 11 and the shoe press, via reversing roll 14, a water-impermeable belt 2 approaches the felt and the interposed tissue web from below, whereafter the felt 3, along with water-impermeable belt 2 and the interposed tissue web, runs into the press gap of the shoe press. The shoe press is comprised of a press shoe 13 arranged on the side of the felt and of a backing roll 12 arranged on the side of belt 2. Upon passing the press gap, felt 3 immediately lifts off the tissue web and belt 2, via a reversing roll 15, and returns to the headbox while belt 2 carries the tissue web onto the next transfer roll 17 fashioned as a suction roll. Approaching from above, a felt 5 again runs over a reversing roll 19 as well to transfer roll 17, with the fiber web sandwiched between felt 5 and belt 2. Transfer roll 17 is fashioned as a suction roll in the wrap region and bears directly on tissue drying cylinder 20, thereby effecting the tissue web transfer to tissue drying cylinder 20. Upon transfer of the tissue web to roll 17, belt 2 returns via reversing roll 18 to headbox 1.

Figure 4:
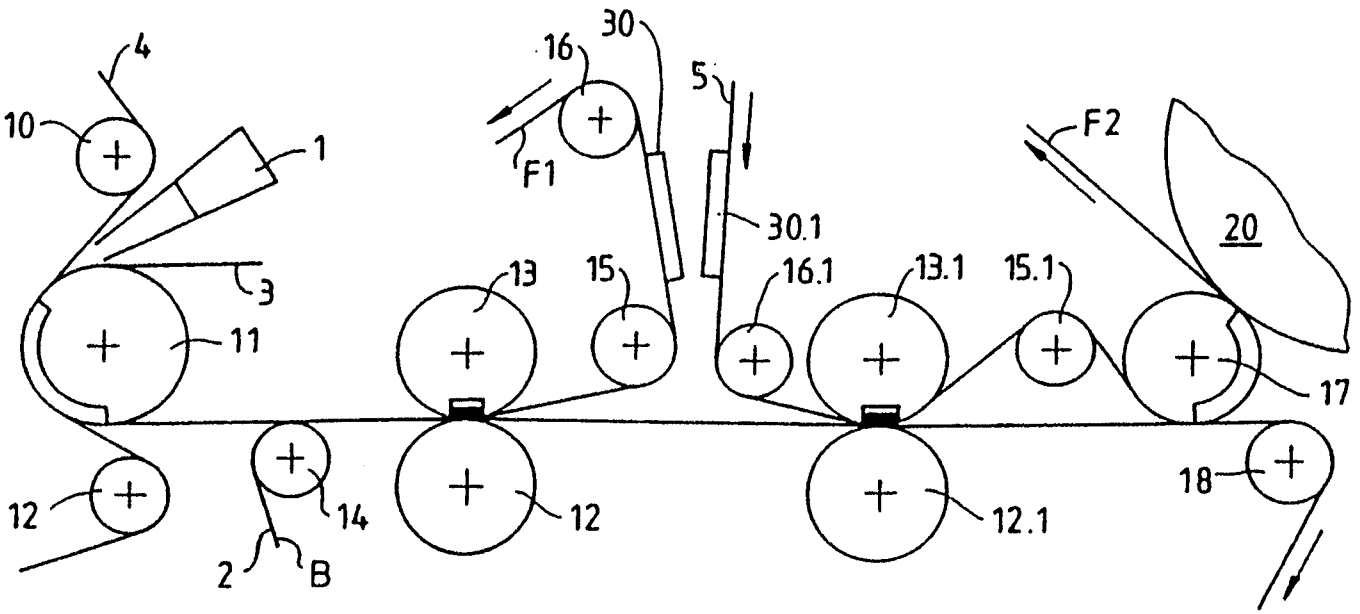

FIG. 4 shows a paper machine for the production of tissue where, beginning again from the left, the headbox 1 is illustrated, injecting its fiber suspension from above right at an angle of about 45° between felt 3 and wire 4. Wire 4 is passed to headbox 1 via reversing roll 10. Wire 4, fiber suspension and felt 3 are jointly passed over sheet former roll 11, which in the wrap region is fashioned as a suction roll. A reversing roll 12 causes wire 4 to part again at the end of the suction roll, whereas felt 3—with the tissue on its underside—travels on as in FIG. 3. The same as described in FIG. 3, a water-impermeable belt 2 approaches the felt and tissue web from below via reversing roll 14. Belt, tissue web and felt enter the following press gap of a shoe press in sandwich fashion. The shoe press consists of a shoe press unit 13 on the felt side and a backing roll 12 on the other side. Upon passage of the press gap, the felt passes again over a reversing roll 15 and separates immediately from the fiber web. After reversing roll 15, felt 3 passes by a suction box for drying felt 30 and returns from there, via the next reversing roll 16, again to headbox 1. Traveling on, belt 2 with the tissue enters then a second press gap, which as well is fashioned as a shoe press with an overhead shoe press 13.1 and a backing roll 12.1 placed underneath. In the gap between presses, felt 5 approaching from above and first passing by a suction box 30.1 travels on to reversing roll 16.1 and from there, via press unit 13.1, directly enters the press gap. Behind the press gap, the felt is again lifted off belt 2 with the aid of a reversing roll 15.1 and thereafter passed again to transfer roll 17. Meanwhile traveling on along a straight line, belt 2 carrying the fiber web as well touches transfer roll 17 tangentially, transferring the tissue web in the lower region to the transfer roll, which in the wrap region is fashioned as a suction roll, and passes the tissue web together with the felt to tissue drying cylinder 20, where the tissue web again is transferred to tissue drying cylinder 20 while felt 5 returns to the suction box 30.1. Running separately after roll 17, belt 2 returns via reversing roll 18 .to roll 14.

Figure 5:
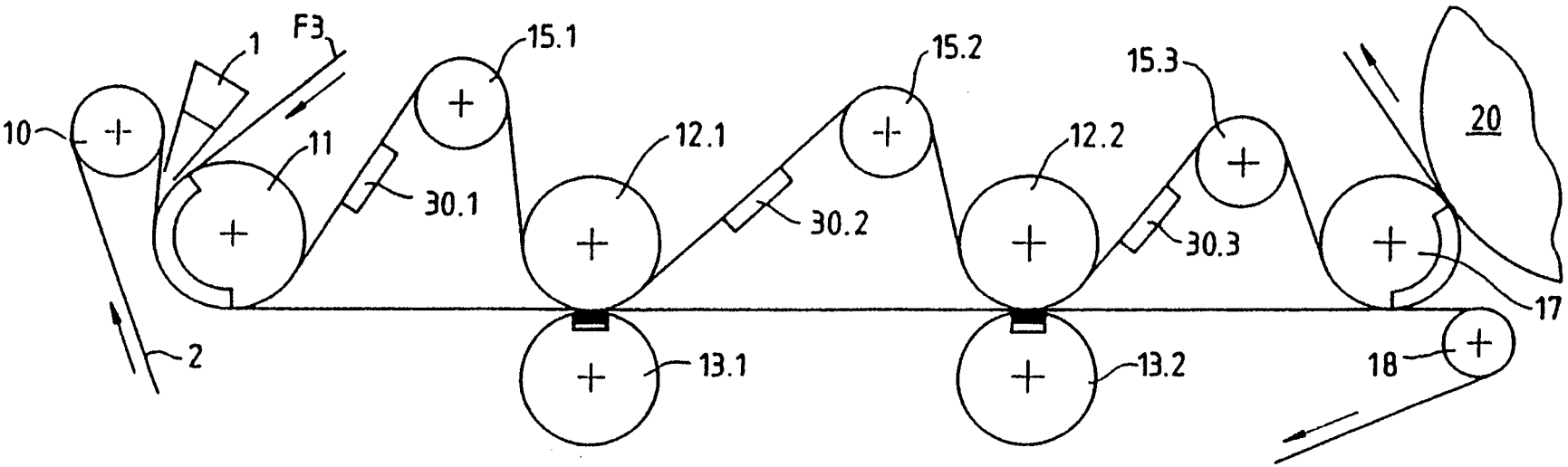

FIG. 5 shows a paper machine for the production of a tissue web, beginning from the left with a headbox 1 injecting its fiber suspension from above right between a water-impermeable belt 2, approaching via reversing roll 10, and a felt 3. These three components pass over a sheet former roll 11 which in the wrap region of the three components comprises a suction zone for dewatering. Following roll 11, felt 3 immediately lifts off the tissue web again. Along with the water-impermeable belt 2, the tissue web travels along a straight line through two press gaps fashioned as shoe presses, and continues directly from there along a straight line to roll 17 for transfer to tissue drying cylinder 20. Between the four rolls 11, 12.1, 12.2 and 17, the felt—via a suction box 30.1, 30.2, 30.3 and a reversing roll 15.1, 15.2, 15.3—is immediately lifted off and returned. Rolls 12.1 and 12.2 are fashioned each as backing rolls to shoe presses 13.1 and 13.2. While the tissue web runs together with the felt around transfer roll 17 with its suction zone and at the point of contact with the tissue cylinder is transferred to the latter, water-impermeable belt 2 travels on along a straight line to reversing roll 18 and returns from there to the headbox. That is, merely two endless surfaces are being used in this arrangement, namely endless belt 2 and meandering felt 3.

Figure 6:
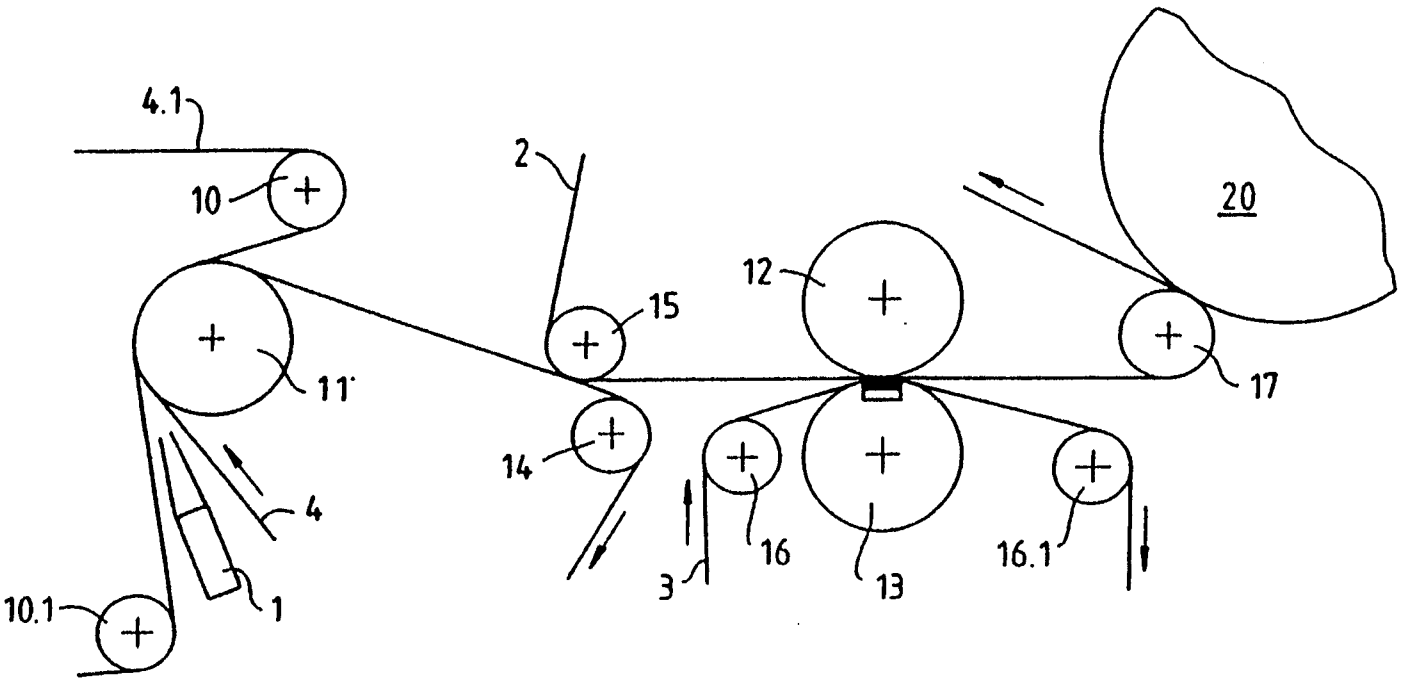

FIG. 6 shows a paper machine for the production of a tissue web, beginning from the left with a headbox 1 which injects the fiber suspension obliquely from below between two wires 4 and 4.1. Coming from below, wire 4 runs across reversing roll 10.1 past headbox to the sheet former roll 11 and returns from there again via reversing roll 10, while wire 4, on the other side of headbox 1, is passed as well to sheet former roll 11, sandwiching there the fiber suspension together with wire 4.1. Coming from roll 11, wire 4 runs together with the formed fiber web to a reversing roll 14, where it is reversed and returned to headbox 1. Contained shortly before reversing roll 14, above the wire, is another reversing roll 15 around which, coming from above, an endless watertight belt 2 is passed, with belt 2 bearing on the tissue web as it wraps around reversing roll 15, picking the tissue web up and carrying it horizontally to the press gap of a shoe press. The shoe press design is such that above, on the side of belt 2, a backing roll is installed while underneath the belt, on the side of the tissue web, a shoe press unit 13 is located around which wraps a felt 3 guided by two reversing rolls 16, 16.1. In the press gap of the shoe press, felt 3 briefly bears on the fiber web and thereafter immediately lifts off again so as to avoid remoistening. Advancing horizontally after the press gap, the belt runs along with the tissue web to a transfer roll 17, which transfers the tissue web to tissue drying cylinder 20, while the belt returns to reversing roll 15.

Figure 7:
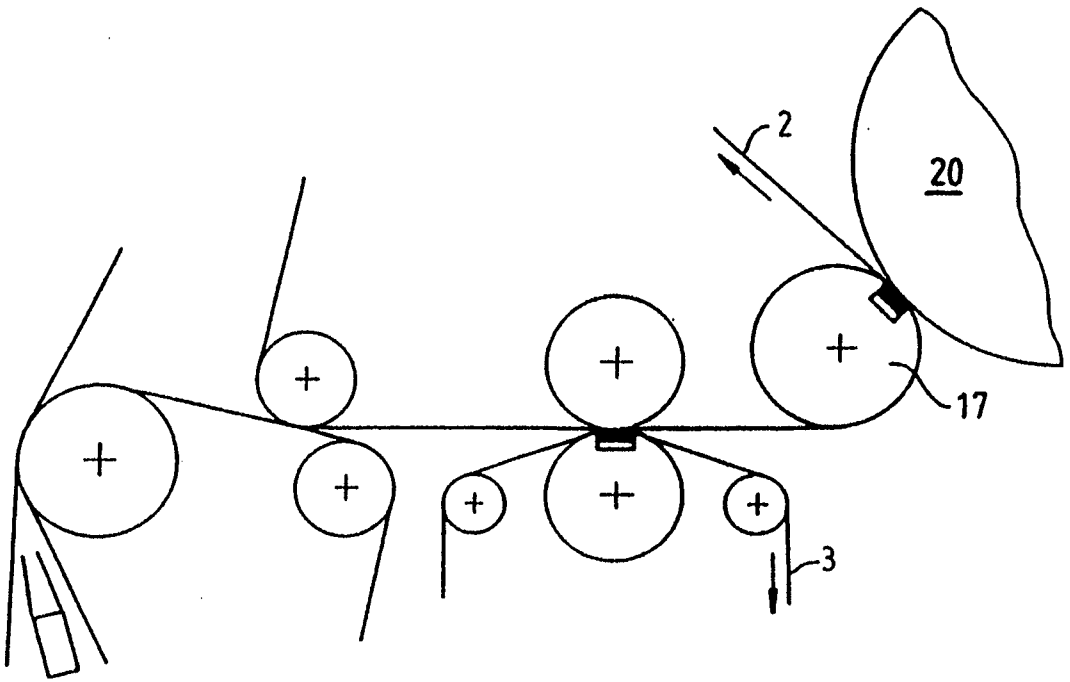

FIG. 7 describes a paper machine having a roll configuration which is similar to that"therefor; illustrated in FIG. 6, but with one difference that reversing roll 17, which in FIG. 6 is provided as a regular roll, has been replaced by a shoe press whose press shoe acts on the tissue drying cylinder 20.

Figure 8:
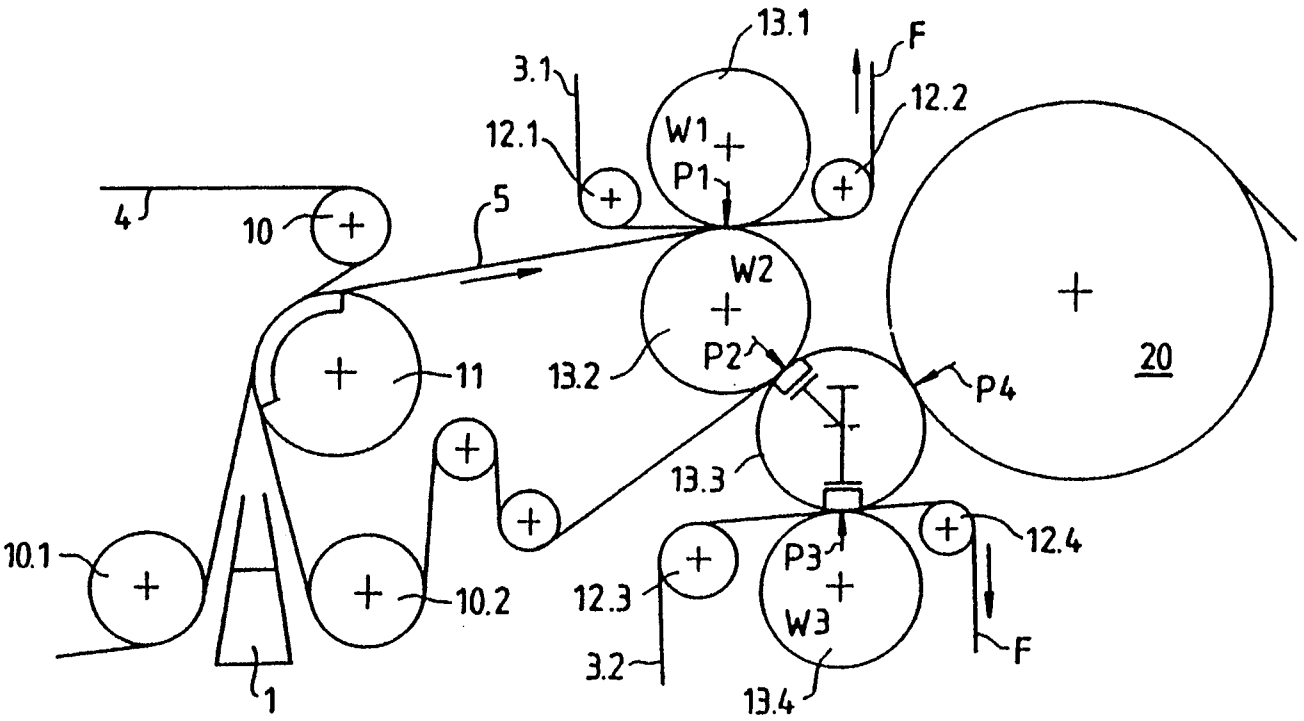
FIG. 8 illustrates another embodiment of the present invention having a paper machine for the production of tissue paper using several shoe presses in an especially compact form.

FIG. 8, lastly, shows a special form of a paper machine for the production of a tissue web. Here, great significance was attached to a compact arrangement of the individual components. The figure shows a headbox which injects the fiber suspension from below between a belt 4 and a wire or felt 5. Wire 4 approaches via reversing roll 10.1, similar to FIG. 2, while the wire, or felt, 5 proceeds as well over a reversing roll, 10.2, at the level of the headbox, to sheet former cylinder 11, which across the wrap angle is provided with a suction zone. Behind the sheet former cylinder 11, belt 4 lifts off again via reversing roll 10, while wire 5 carries the tissue web on to the first press gap. The first press gap may be of both conventional and shoe press design, with a felt approaching the press gap from above via reversing roll 12.1. The press gap is formed by the overhead press device 13.1 and the press device 13.2 placed underneath. Behind the press gap, the felt again lifts off the fiber web via reversing roll 12.2 and, by way of further reversals, travels to first reversing roll 12.1. Wire 5 remains after the first press gap in contact with press device 13.2 while underneath, offset somewhat to the right, a further shoe press uses press device 13.2 as backing roll, thus passing wire 5 along with the tissue web through this shoe press. In this shoe press, the tissue web is at the same time transferred on the press shell of shoe press 13.3, while the wire—via several reversing rolls—returns to the headbox. Shoe press 13.3 is of a design such that it comprises in its lower part a side press shoe to which the tissue web advances directly, with a further backing roll 13.3 provided opposite the lower press shoe, around which backing roll, by way of two reversing rolls 12.3 and 12.4, a further felt 3.2 travels through the press gap. After this second pressing operation of press device 13.3 the paper web continues to be held on the shell and runs to a third nip of this press device 13.3, which in this case features the tissue cylinder as backing cylinder, and the tissue web transfers at this nip to tissue drying cylinder 20. Here it is also possible to fashion this nip as a shoe press, if a stronger drying is desired.

What is claimed is:

1. A paper machine for producing a tissue web, comprising:

at least one headbox;

at least one dewatering unit;

at least one water impermeable belt for carrying the tissue web;

at least one press unit disposed downstream from said at least one dewatering unit, each press unit including a shoe press for drying the tissue web and a press felt carried by and disposed immediately adjacent to said shoe press, each said press unit including means for immediately separating said press felt from the tissue web on the immediate downstream side of said shoe press;

a tissue drying cylinder disposed downstream from said at least one press unit; said water impermeable belt extending through each said press unit to said tissue drying cylinder, each said press unit being structured and arranged for the tissue web to be disposed between and immediately adjacent to said press felt and said water impermeable belt, and wherein an adhesion force between said water impermeable belt and the tissue web is greater than an adhesion force between said press felt and the tissue web.

2. The paper machine of claim 1, further comprising a shoe press disposed at and coacting with said tissue drying cylinder.

3. The paper machine of claim 2, wherein said water impermeable belt extends from said headbox to said tissue drying cylinder.

* * * * *